US005803012A

United States Patent [19]

Kamen

[11] Patent Number: 5,803,012

[45] Date of Patent: Sep. 8, 1998

[54] BOOK MARK

[76] Inventor: Jack M. Kamen, 8782 N. Cricket Tree La., Indianapolis, Ind. 46260

[21] Appl. No.: 742,884

[22] Filed: Nov. 1, 1996

[51] Int. Cl.[6] ..... B42D 9/00

[52] U.S. Cl. ..... 116/235

[58] Field of Search ..... 116/234, 235, 116/236, 237, 238, 239, 240; 281/42

[56] References Cited

U.S. PATENT DOCUMENTS

| | | | |
|---|---|---|---|
| D. 32,731 | 5/1900 | Conger . | |
| D. 333,317 | 2/1993 | Jimenez | D19/32 |
| 446,857 | 2/1891 | Fiske | 116/235 |
| 1,966,340 | 7/1934 | Forbringer et al. | 116/235 |
| 2,475,698 | 7/1949 | Croker | 116/235 X |
| 2,543,182 | 2/1951 | Lang . | |
| 2,953,115 | 9/1960 | Haskins | 116/235 |
| 4,358,012 | 11/1982 | Marsala et al. | 281/42 X |
| 4,901,665 | 2/1990 | Carlin | 116/235 |
| 5,311,835 | 5/1994 | Knowles | 116/235 |
| 5,325,811 | 7/1994 | Miroyan | 116/235 |
| 5,515,809 | 5/1996 | Weinberg | 116/235 |

*Primary Examiner*—William A. Cuchlinski, Jr.
*Assistant Examiner*—Willie Morris Worth
*Attorney, Agent, or Firm*—Barnes & Thornburg

[57] ABSTRACT

A book mark is provided for marking a selected line and page of a book where a reader should resume reading. The book mark includes a flat elongated member, first and second page indicators, and a marker. The flat elongated member has a first end, a second end spaced apart from the first end, a middle region situated between the first and second ends, a first side, and a second side facing away from the first side. Each of the first and second page indicators includes an indicia positioned on the flat elongated member. The marker marks the selected line, is fixed relative to and spaced apart from the first and second page indicators, and is situated in the middle region of the flat elongated member.

28 Claims, 1 Drawing Sheet

BOOK MARK

BACKGROUND AND SUMMARY OF THE INVENTION

The present invention relates to a bookmark that a reader uses to mark a particular location in a book. More particularly, the present invention relates to a bookmark that marks a particular page and line in the book where the reader wishes to resume reading.

Readers use books as a source of entertainment and education and often find it necessary to stop reading a book before they have finished reading the book. It is convenient to mark a location in the book where the reader stops reading to reduce the time needed to find the location in the book when the reader wishes to resume reading later.

Bookmarks are widely used. Some bookmarks only mark the two pages of the book that the reader had open when she or he stopped reading. Other bookmarks mark an exact page and line where the reader stopped reading. See, for example, U.S. Pat. Nos. 2,563,182 to Lang; 4,901,685 to Carlin; and 5,345,881 to Miroyan.

Many readers find conventional bookmarks unreliable because the bookmark slips within the book after she or he marks the page and line in the book. Pressure on an exposed portion of the bookmark outside the book, movement of the book, gravity, or other forces can cause such movement. Movement of the bookmark causes the bookmark to lose the marked line and consequently, the reader must waste time hunting for the last line read. A bookmark that marks the page and exact line of a book and that does not easily slip would be a welcomed improvement.

Bookmarks consisting of multiple pieces can be more difficult and costly to produce than bookmarks made of only one piece. Furthermore, a one-piece bookmark would be less likely to break and become dysfunctional than a multiple-piece bookmark. Thus, a bookmark made of one piece would be a useful advancement.

What is needed is a bookmark that allows readers to mark the location of a page and an exact line on that page and that does not easily slip relative to that line. Furthermore, it would also be desirable if that bookmark was of a simple one-piece design that was easy to manufacture and unlikely to become dysfunctional.

According to the present invention, a bookmark is provided that indicates a page and marks a line of a book. The bookmark includes a flat elongated member having a first end and second end spaced apart from the first end. The bookmark also includes page indicators located on the first and second ends for indicating a page of the book. The flat elongated member also includes a middle region located between the first and second ends. The bookmark includes a line marker for marking a line of the book which is appended to the middle region of the flat elongated member. The flat elongated member also includes a first side and second side facing away from the first side. Further, the flat elongated member includes a first edge and a second edge spaced apart from the first edge. The first and second edges extend between the first and second ends.

The page indicators can be a variety of indicia including, but not limited to: "Right" and "Left", "R" and "L", left arrow and right arrow, and "TOP". When the reader looks at an open book, generally a left-hand page and a right-hand page face the reader. The page indicators allow a reader to either mark the left-hand page or the right-hand page as the page on which to resume reading. For example, for a bookmark with "Right" and "Left" indicia as page indicators, the reader would place a page indicator with the "Right" indicia near the top of the book if she or he stopped reading on the right-hand page. When the reader returns to read the book, she or he notes the "Right" indicia on the page indicator near the top of the book and continues reading on the right-hand page. The reader saves time by not having to scan both the left-hand and the right-hand pages while searching for the location at which to resume reading.

In preferred embodiments of the present invention, the line marker can be in the form of a pair of arrowhead-shaped detents appended to the middle region of the flat elongated member or arrowhead-shaped notches formed in the middle region of the flat elongated member. The line marker allows the reader to mark the exact line she or he wishes to resume reading later by aligning the line marker with the line to be marked. When the reader returns to read the book, she or he opens the book, scans an edge of the bookmark for the line marker, and continues to read at the marked line. The reader saves time by not having to scan the entire page for the line on which to continue reading.

Further, the line marker of the present invention is fixed in the middle region of the bookmark relative to the first and second ends. This allows for a one-piece design that should reduce the manufacturing cost of the bookmark and also decrease the potential that the bookmark could break and become dysfunctional.

In another preferred embodiment of the present invention, the flat elongated member is made of a pliable material such as suede or a suede-like material. The compliant and flexible characteristics of the pliable material help prevent the bookmark from moving if forces are applied to an exposed portion of the bookmark lying outside a closed book. Because the flat elongated member is pliable, it is less likely to move in a book if the bookmark is pushed, whereas a less pliable or rigid bookmark would have a tendency to move and lose a marked line.

The flat elongated member is also compressible. When the bookmark is pinched, the material compresses and reduces its thickness. Compression of this nature occurs when a bookmark is lying within a closed book. This compression helps prevent the bookmark from moving, whereas a non-compressible material would be more likely to slip.

In yet another preferred embodiment, the first and second sides of the flat elongated member have a high coefficient of friction relative to paper as found in suede or a suede-like material. This high coefficient of friction helps the bookmark resist forces that could push or pull a conventional bookmark and thus lose the marked line and possibly the indicated page.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWING

The detailed description particularly refers to the accompanying figures in which.

DETAILED DESCRIPTION OF THE DRAWINGS

Figure 1:
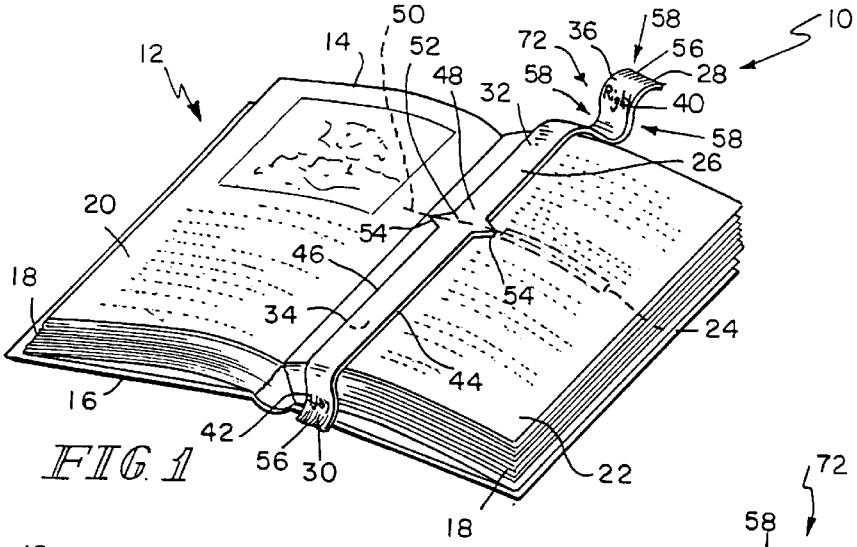
FIG. 1 is a perspective view of a bookmark lying in an open book showing the bookmark including a flat elongated member placed within the open book, a page indicator indicating a specific page in the book, and a line marker marking a particular line of text, the page indicators being "Right" and "Left" indicia and the line marker being a pair of detents appended to the flat elongated member.

FIG. 1 shows a bookmark 10 lying within an open book 12. The book 12 includes a top end 14, a bottom end 16, and a plurality of pages 18. When book 12 is open, a left-hand page 20 and a right-hand page 22 face a reader of the book 12. The right-hand page 22 includes a particular line of text 24 as shown in FIG. 1. The bookmark 10 is marking the right-hand page 22 and the particular line of text 24.

Figure 3:
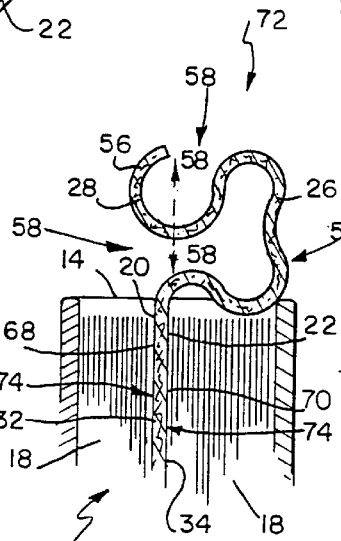
FIG. 3 is a sectional view taken along line 3—3 of FIG. 2 showing the bookmark in contact with the closed book and the pliable nature of the flat elongated member.

The bookmark 10 includes a flat elongated member 26 having a first end 28, a second end 30 spaced apart from the first end 28, a first side 32, and a second side 34 which is facing away from the first side 32 as shown in FIGS. 1 and 3. The bookmark 10 further includes a first page indicator 36 on the first end 28 and second page indicator 38 on the second end 30. As shown in FIG. 1, the first page indicator 36 of bookmark 10 includes a "Right" indicia 40 that is indicating the right-hand page 22 of the book 12 and the second page indicator 38 of bookmark 10 includes a "Left" indicia 42. The second side 34 also includes a first page indicator 36 and the second page indicator 38.

A reader indicates the last page read by placing an appropriate end 28, 30 of the bookmark 10 at the top end 14 of the open book 12. The reader selects the appropriate end 28, 30 of the bookmark 10 by noting whether she or he stopped reading on the left-hand page 20 or the right-hand page 22. The reader selects the end 28 with the "Right" indicia 40 when she or he should resume reading on the right-hand page 22 or she or he selects the end 30 with the "Left" indicia 42 when she or he should resume reading on the left-hand page 20. The reader then places the selected end 28, 30 at the top end 14 of the book 12 and closes the book 12.

When the reader resumes reading, she or he references the indicia 40, 42 on the end 28, 30 of the bookmark 10 near the top end 14 of the book 12. This indicia 40, 42 notifies the reader as to which page 20, 22 to resume reading. As shown in FIG. 1, the reader placed the end 28 with the "Right" indicia 40 at the top end 14 of the book 12 when she or he stopped reading the book 12. Therefore, the reader should resume reading on the right-hand page 22 as indicated by the "Right" indicia 40. By referencing the indicia 40, 42 near the top end 14 of the book 12, the reader saved time by not having to scan both pages 20, 22 of the book 12 to determine where to resume reading. Therefore, the bookmark 10 has not only proved useful in indicating within a two page region which page to resume reading, but has also indicated the exact page 22 where to resume reading from the book 12.

The flat elongated member 26 includes a first edge 44 and a second edge 46. The flat elongated member 26 also includes a middle region 48 located between the first and second ends 28, 30. The middle region 48 includes a center 35 line 50. The center line 50 intersects the first edge 44 and the second edge 46 equidistant from the first end 28 and the second end 30. The bookmark 10 includes a line marker 52 located along center line 50 and on the first and second sides 32, 34. As shown in FIG. 1, the line marker 52 is marking the particular line of text 24. The line marker 52 includes a pair of arrowhead-shaped detents 54 that interrupt and are located on the first and second edges 44, 46 and are appended to the flat elongated member 26.

A reader indicates a specific line on which she or he wishes to resume reading by moving the entire bookmark 10 and aligning the line marker 52 with the specific line to be marked. When the reader resumes reading the book 12, she or he scans the first edge 44 and/or the second edge 46 for the line marker 52. Once the line marker 52 is located, the reader resumes reading at the marked line. Therefore, the bookmark 10 has not only proved useful in indicating a page on which to resume reading, but has also marked the exact line where to resume reading the book 12.

As FIG. 1 shows, the line marker 52 is fixed relative to the first end 28 and the second end 30 in the middle region 48. Because the line marker 52 is fixed to the middle region 48, the bookmark 10 is a one-piece design. Typically, one-piece designs are easier and less expensive to manufacture than multiple-piece designs. Furthermore, one-piece designs are typically less likely to break and become dysfunctional than multiple-piece designs.

Figure 2:
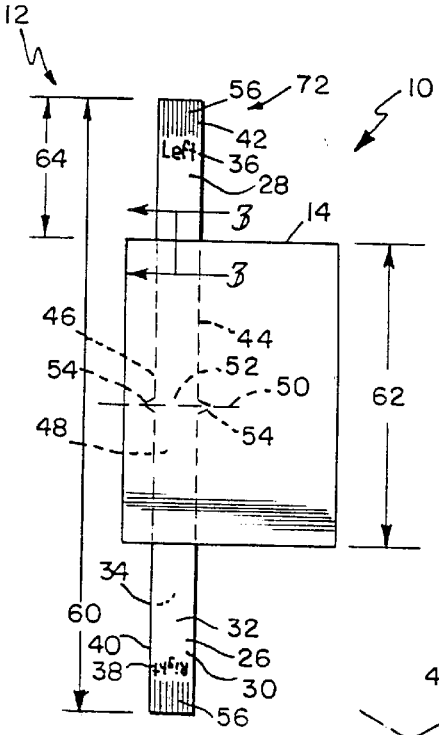
FIG. 2 is a top plan view of the bookmark of FIG. 1 showing the bookmark lying within a closed book and the bookmark having a length and the book having a book height that is less than the length of the bookmark.

The bookmark 10 is shown in FIG. 2 within a closed book 12. The "Left" indicia 42 is located near the top end 14 of the book 12. This indicates that the left-hand page 20 was indicated by the reader before the reader closed the book 12.

The bookmark 10 shown in FIG. 2 has a length 60 and the book 12 has a height 62 that is less than the bookmark length 60. The greater length 60 of bookmark 10 permits one bookmark 10 to be used with many size books 12.

The bookmark 10 also has a pliable nature as shown in FIGS. 1 and 3. The difference between the bookmark length 60 and the book height 62 along with the pliable nature of the bookmark 10 allows a reader to mark more than one page in a book 12 at a time. The reader can mark one page in the book 12 then fold the bookmark 10 over to mark another page in the book 12.

Furthermore, the bookmark 10 has an excess length 64 that extends beyond the top end 14 of the book 12. The excess length 64 of the bookmark 10 allows the reader to roughly approximate the location of the line marker 52 within the book 12 by noting the amount of excess length 64 of the bookmark 10. This allows the reader reduce the time needed to scan along the first edge 44 and/or second edge 46 to find the line marker 52 because the reader knows in advance of opening the book 12 approximately where the line marker 52 is located.

The bookmark 10 is also shown in FIG. 3. The bookmark 10 is located within the closed book 12 and has exterior compressive and tensile forces 58 acting upon it. Such forces 58 can be created by contact with objects, gravity, changes in momentum, jarring or tilting the book, and from other sources. The left-hand page 20 of the book 12 has a left-hand page surface 68 and the right-hand page 22 has a right-hand page surface 70. The first and second sides 32, 34 of the bookmark 10 have surfaces with high coefficients of friction relative,to paper. A surface having a high coefficient of friction creates greater resistive frictional force to act against an applied force 58 than a low coefficient of friction surface creates. When the first and second sides 32, 34 come into contact with the left-hand and right-hand page surfaces 68, 70, respectively, friction is created. This friction helps resist the potential movement of bookmark 10 created by the exterior compressive or tensile forces 58 applied to the bookmark 10.

The bookmark 10 also includes a decorative fringe 56 located on the first and second ends 28, 30 of the flat elongated member 26 as shown, for example, in FIGS. 1 and 2. The decorative fringe 56 makes the first and second ends 28, 30 more pliable. This increased pliability decreases the likelihood that the forces 58 will push the bookmark 10 away from its line marking position. Furthermore, the decorative fringe 56 makes the bookmark 10 more aesthetically pleasing to many readers. In alternative embodiments of the present invention, the bookmark does not need to include a decorative fringe.

As mentioned above, the bookmark 10 is made of a pliable material. A pliable material is both flexible and compliant. Because the bookmark 10 is pliable, exposed ends of the bookmark 10 situated outside of the book 12 may be folded over and placed between two pages in the book 12 so that the book 12 may be easily placed on a shelf without the bookmark 10 interfering with the placement of the book 12 on the shelf.

Pliable members cannot support compressive loads or forces 58. Because bookmark 10 is pliable, exterior compressive forces 58 applied to the exposed portion 72 of the bookmark 10 will not move the bookmark 10 and cause the marked line to be lost. Furthermore, because the bookmark 10 is made of a pliable material, it is more convenient to store or transport than a more rigid member. A pliable member can be manipulated into many forms. For example, the bookmark 10 can be folded up to fit into a pocket or a purse for easy transportation or storage. The bookmark's pliable nature also resists snapping and breaking that can occur with more rigid elongated bodies.

Also, the bookmark 10 is made of a compressible material. A compressible material deforms when compressive forces 74 are applied to it. As shown in FIG. 3, when the book 12 is closed with the bookmark 10 within it, internal compressive forces 74 are applied to the bookmark 10 which cause the bookmark 10 to deform. This internal compressive force 74 and the deformation allows the bookmark 10 to rest more securely within the closed book 12.

Suede leather is an example of a material that is pliable, has surfaces with high coefficients of friction, and is compressible. Other suitable materials also exist with these properties that could be used for the bookmark 10.

Figure 4:
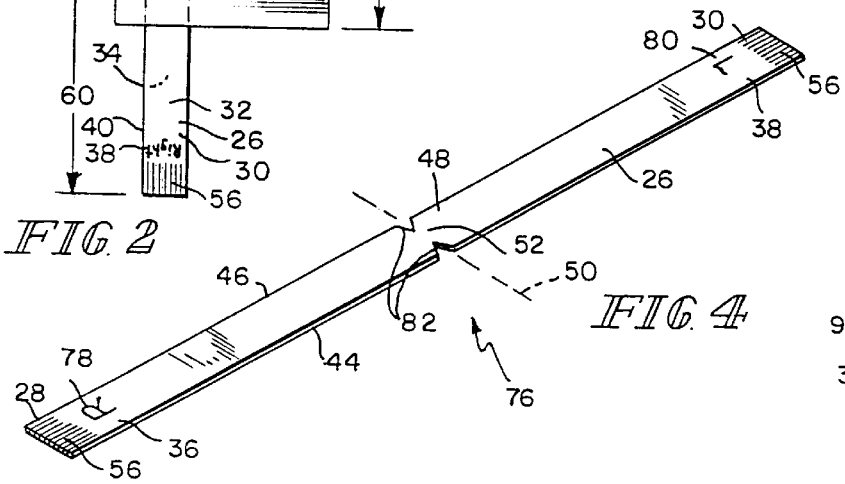
FIG. 4 is a perspective view of another preferred embodiment of a bookmark according to the present invention showing the bookmark including a flat elongated member, page indicators being "R" and "L" indicia, and a pair of line markers being a pair of notches formed in the flat elongated member.

Another bookmark 76 according to the present invention is shown in FIG. 4. The page indicators 36, 38 include a "R" indicia 78 on the first end 28 and a "L" indicia 80 on the second end 30. This embodiment of the bookmark 76 includes the line marker 52 having arrowhead-shaped notches 82 formed in the flat elongated member 26 which interrupt the first and second edges 44, 46.

Figure 5:
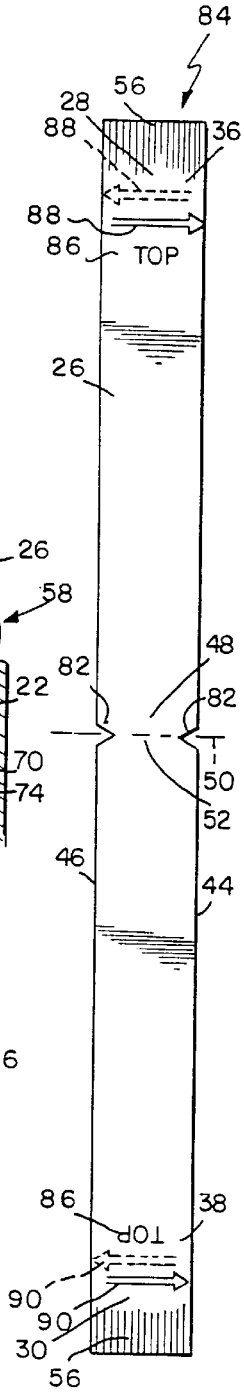
FIG. 5 is a top plan view of yet another preferred embodiment of the present invention showing a bookmark including a flat elongated member, page indicators being arrows and "Top" indicia, and a pair of line markers being a pair of notches formed in the flat elongated member.

Yet another bookmark 84 according to the present invention is shown in FIG. 5. The first and second page indicators 36, 38 include a "TOP" indicia 86 located on the first and second ends 28, 30 of the flat elongated member 26. Furthermore, the first page indicator 36 includes a right-pointing arrow indicia 88 located on the first end 28 and the second page indicator 38 includes a the left-pointing (when FIG. 5 is viewed wrong-side up) arrow indicia 90 located on the second end 30. The first and second page indicators 36, 38 also includes the "TOP" indicia 86 located on the second side 34 at both ends 28, 30, the right-pointing arrow indicia 88 located on the first end 28 of the second side 34, and the left-pointing arrow indicia 90 located on the second end 30 of the second side 34.

In alternative embodiments of the present invention, the arrow indicia may be used without the TOP indicia. In alternative embodiments of the present invention, other indicia may be used to indicate the last page read.

The "TOP" indicia 86 notifies the bookmark user to place the corresponding indicator 36, 38 near the top end 14 of the book 12. It also reminds the reader upon resuming reading the book 12 that the corresponding page indicator 36, 38 is located near the top end 14. This helps to eliminate potential confusion for a reader that has forgotten how to use the bookmark over a period of time.

When the right-pointing arrow indicia 88 is located near the top end 14 of the book 12, the reader is notified to continue reading on the right-hand page 22. Conversely, when the left-pointing arrow indicia 90 is located near the top end 14, the reader is notified to continue reading on the left-hand page 20.

Although this invention has been described in detail with reference to certain embodiments, variations and modifications exist within the scope and spirit of the invention as described and as defined in the following claims.

I claim:

1. A bookmark for use in a book including a height and a plurality of pages, each of the plurality of pages have a plurality of lines, and when the book is open a right-hand page and a left-hand page face a reader of the book, the bookmark comprising a flat elongated member having a first end, a second end spaced apart from the first end, a middle region situated between the first and second ends, a first side, and a second side facing away from the first side, first and second page indicators, each of said first and second page indicators including indicia positioned on the flat elongated member, and a marker for marking a selected line, the marker being fixed relative to and spaced apart from the first and second page indicators, and the marker being situated in the middle region of the flat elongated member.

2. The bookmark of claim 1, further comprising means for maintaining the marker in a fixed position relative to the marked line.

3. The bookmark of claim 2, wherein the maintaining means includes the flat elongated member being made of a pliable material.

4. The bookmark of claim 2, wherein the maintaining means includes the first and second sides of the flat elongated member having a high coefficient of friction relative to paper.

5. The bookmark of claim 2, wherein the maintaining means includes the flat elongated member being made of a compressible material.

6. The bookmark of claim 1, wherein the flat elongated member includes a length that is greater than a height of a book.

7. A bookmark for use in a book, the bookmark comprising a flat elongated member having a first end, a second end spaced apart from the first end, a middle region situated between the first and second ends, a first side, and a second side facing away from the first side, first and second page indicators, the first page indicator being connected to the first end of the flat elongated member, the second page indicator being connected to the second end of the flat elongated member, and the first page indicator being different than the second page indicator, and a line marker for marking a selected line of a page of a book as a marked line, the line marker being connected to the middle region of the flat elongated member, and the line marker being fixed relative to the first and second ends.

8. The bookmark of claim 7, wherein the flat elongated member is pliable.

9. The bookmark of claim 7, wherein the flat elongated member is compressible.

10. The bookmark of claim 7, wherein the first and second sides have a high coefficient of friction relative to paper.

11. The bookmark of claim 7, wherein the first side and second side both include the first and second page indicators and the line marker.

12. The bookmark of claim 7, wherein the first and second page indicators include indicia shaped as arrows.

13. A bookmark for use in a book, the bookmark comprising a flat elongated member having a first end, a second end spaced apart from the first end, a middle region situated between the first and second ends, a first side, a second side facing away from the first side, a first edge, and a second edge spaced apart from the first edge.

first and second page indicators, the first page indicator being connected to the first end of the flat elongated member and the second page indicator being connected to the second end of the flat elongated member, and a line marker connected to the middle region of the flat elongated member, the line marker being fixed relative to the first and second ends, the line marker including a pair of line markers located in the middle region, the pair of line markers interrupting and being located on the first and second edges, and the pair of line markers being equidistant from the first end.

14. The bookmark of claim 7, wherein the bookmark further includes a decorative fringe at the first and second end.

15. The bookmark of claim 1, wherein the flat elongated member includes decorative fringe on the first and second ends.

16. The bookmark of claim 1, wherein the first and second sides both include the first and second page indicators and the marker.

17. The bookmark of claim 1, wherein the first and second page indicators are shaped as arrows.

18. The bookmark of claim 13, wherein the flat elongated member is pliable.

19. The bookmark of claim 13, wherein the first and second sides have a high coefficient of friction relative to paper.

20. The bookmark of claim 13, wherein the first and second page indicators are spaced apart from the line marker and include indicia positioned on the flat elongated member.

21. The bookmark of claim 13, wherein the flat elongated member is compressible.

22. A bookmark for use in a book including a height and a plurality of pages, each of the plurality of pages have a plurality of lines, and when the book is open a right-hand page and a left-hand page face a reader of the book, the bookmark comprising a flat elongated member having a first end, a second end spaced apart from the first end, a middle region situated between the first and second ends, a first side, and a second side facing away from the first side, first and second page indicators, the first page indicator being fixed on the first end of the flat elongated member, and the second page indicator being fixed on the second end of the flat elongated member, and a pair of markers for marking a selected line on the indicated page as a marked line, the markers being fixed relative to the first and second page indicators, and the pair of markers being situated in the middle region of the flat elongated member.

23. The bookmark of claim 22, wherein the flat elongated member is made of a pliable material.

24. The bookmark of claim 22, wherein the flat elongated member includes a length that is greater than a height of a book.

25. The bookmark of claim 22, wherein the flat elongated member is made of a material having a high coefficient of friction in comparison to paper.

26. The bookmark of claim 22, wherein the bookmark further includes a decorative fringe at the first and second ends.

27. The bookmark of claim 22, wherein the first and second sides both include the first and second page indicators and the pair of markers.

28. The bookmark of claim 22, wherein the first and second page indicators are spaced apart from the pair of markers and include an indicia positioned on the flat elongated member.

* * * * *